United States Patent [19]

Port et al.

[11] 3,960,545

[45] June 1, 1976

[54] CERMET PLASMA FLAME SPRAY POWDER, METHOD FOR PRODUCING SAME AND ARTICLES PRODUCED THEREFROM

[75] Inventors: David J. Port, Athens; William D. Lafferty; Richard F. Cheney, both of Towanda, all of Pa.

[73] Assignee: GTE Sylvania Incorporated, Stamford, Conn.

[22] Filed: Mar. 24, 1975

[21] Appl. No.: 561,638

[52] U.S. Cl. ..... 75/.5 R; 75/.5 AC; 75/.5 BC; 106/290

[51] Int. Cl.[2] ..... B22F 9/00

[58] Field of Search ..... 75/.5 R, .5 BB, .5 AB, 75/.5 AC, .5 BC; 106/290

[56] References Cited

UNITED STATES PATENTS

| | | | |
|---|---|---|---|
| 3,254,970 | 6/1966 | Dittrich et al. | 75/.5 BC |
| 3,407,057 | 10/1968 | Timmons | 75/.5 BB |
| 3,415,640 | 12/1968 | Lambert | 75/.5 AC |
| 3,881,911 | 5/1975 | Cheney et al. | 75/.5 BB |

*Primary Examiner*—W. Stallard

*Attorney, Agent, or Firm*—N. J. O'Malley; J. C. Fox; D. R. Castle

[57] ABSTRACT

Plasma flame spray coatings exhibiting improved hardness and wear resistance are produced from flame spray powders comprising spray dried agglomerates of finely divided molybdenum and alumina powder subparticles, wherein the diameters of the agglomerates are at least two times the maximum diameter of the subparticles.

9 Claims, No Drawings

CERMET PLASMA FLAME SPRAY POWDER, METHOD FOR PRODUCING SAME AND ARTICLES PRODUCED THEREFROM

BACKGROUND OF THE INVENTION

1. Field of the Invention

This invention relates to an improved plasma flame spray powder, and to a method for producing such powder, and to composite articles of manufacture including outer plasma flame sprayed coatings of such powders, and more particularly relates to a cermet plasma flame spray powder, method for producing it, and articles therefrom.

2. Prior Art

Free flowing powders are useful in a variety of applications in the ceramic and metallurgical arts, such as in the formation of powder compacts, in casting and in coating operations, such as plasma flame spraying.

Metallic and ceramic flame spray coatings are frequently applied to various articles to impart properties such as hardness, wear resistance, good lubricity, corrosion resistance, improved electrical properties or perhaps simply to build up a used part which has worn below usable tolerances.

The concept of combining metals and ceramics is widely used today to achieve various superior properties of the resulting composite material which could not be achieved by use of either component alone. Cermets offer the combination of strength and toughness of metals with the high temperature resistance of ceramics. This combination also provides unique properties in plasma flame sprayed coatings. For example, coatings of superior wear resistance can be produced with cermet compositions.

One difficulty encountered in the prior art with cermet flame spray powders has been the temperature resistance of the ceramic component. It would be desirable to melt both components completely in the short residence time in the plasma flame in order to achieve a dense, well bonded flame sprayed coating.

Prior art includes several methods for combining metal and ceramic components in flame spray powder form. The simplest is to mix individual powders, each of a size generally acceptable for plasma flame spraying, about minus 100 mesh to plus 10 microns. However, because of the difference in melting points of the metal and ceramic powders and the individual reaction of each component particle in the plasma flame, it is difficult to melt both components without overheating, the lower melting component, resulting in undesirable oxidation of the metallic component or in extreme cases its vaporization during spraying.

Another approach is to produce individually clad particles. Either a core of metal clad with a ceramic or a core of ceramic clad with metal is proposed in U.S. Pat. No. 3,655,425 by Longo et al. The choice of materials for combination is usually limited in this method, however, due to the limited ability to clad one material upon another, particularly in view of the desire to retain some exposure of the surface of the core material for best results.

SUMMARY OF THE INVENTION

In accordance with the invention it has been discovered that the good thermal conductivity of the metallic component such as molybdenum together with a high surface area of contact between the metallic and the ceramic components such as alumina may be utilized to achieve substantially complete melting of the cermet plasma flame spray powder during the relatively short residence time in the plasma flame. It has been discovered that if the two components are in the form of finely divided powders and are brought into intimate contact in a substantially uniform distribution in powder agglomerates, the thermal conductivity of the metallic component will result in distribution of sufficient heat throughout the agglomerate to achieve fusion of the finely divided ceramic component particles. Flame sprayed coatings produced from such agglomerated powders are characteristically well fused, dense, hard, and wear resistant. The invention thus includes cermet plasma flame spray powders comprising agglomerates of finely divided particles of molybdenum or its alloys and alumina, and also includes composite articles of manufacture including an outer plasma flame sprayed coating of such a powder, such coating exhibiting excellent hardness and wear resistance.

In another embodiment of the invention, a method is provided for producing the agglomerated flame spray powder of the invention, the method comprising spray drying with a binder a slurry of finely divided powder particles of molybdenum or its alloys and alumina.

DETAILED DESCRIPTION OF THE INVENTION

The flame spray powder of the invention comprises agglomerates of powder particles of molybdenum or alloys of molybdenum containing at least 50 percent by weight of molybdenum together with alumina particles in the amount of from 1 to 50 percent by weight of the flame spray powder, and preferably from 5 to 20 percent by weight of the flame spray powder. Agglomeration of the finely divided starting powders may be by any of several techniques known in the art although in a preferred embodiment such agglomeration is achieved by spray drying a slurry of the starting powders with a suitable binder. Agglomeration conditions should be chosen in order to achieve agglomerate diameters at least two times, and preferably four times the maximum diameters of the particle diameters. By way of example, molybdenum starting powder having particle sizes from about 1 to 10 micrometers and preferably 2 to 3 micrometers, and alumina particles having sizes less than 10 micrometers and preferably less than 1 micrometer are agglomerated to produce agglomerates 90 percent within the range of −200 (74 micrometers) to +325 (44 micrometers) mesh. A suitable binder material for spray drying to produce such agglomerates is a thermally decomposable compound of molybdenum, such as ammonium molybdate. This may be conveniently formed in the case in which an aqueous slurry is utilized for spray drying by the addition of molybdenum trioxide and ammonium hydroxide to the slurry. These constituents combine an aqueous media to form ammonium molybdate which has been found to be a suitable spray drying binder. Following spray drying the resulting agglomerates may be classified according to size by conventional techniques such as screening to produce size fractions suitable for the intended flame spray powder application. A typical size fraction which has been found suitable for producing coatings having superior hardness and wear resistance is 90 percent between −200 to +325 mesh. Following such size classification, the powder is advantageously subjected to a sintering step at conditions of time and temperature sufficient to substantially increase the bulk density of the agglomerates, and therefore of the flame spray powder, but insufficient to result in substantial sintering together of agglomerates, which would result in an unusable mass, cake, or sponge of material. Such conditions are not a necessary part of this description, but are well within the skill of the art to effect.

EXAMPLE

Two sample powders having the composition in weight percent 6 percent alumina remainder molybdenum and 20 weight percent alumina remainder molybdenum were prepared by the following procedure: The molybdenum powder had a size range from about 1 to 10 micrometers and the alumina had a size nominally less than 1 micrometer. These powders were suspended in water-base slurries together with molybdenum trioxide and ammonium hydroxide in the proportions listed in Table I.

TABLE I

| Mo — 6% $Al_2O_3$ | Mo — 19% $Al_2O_3$ |
|---|---|
| 2.5 lbs $Al_2O_3$ | 10 lbs $Al_2O_3$ |
| 7.5 lbs $MoO_3$ | 7.5 lbs $MoO_3$ |
| 42.5 lbs Mo | 35 lbs Mo |
| 2 gal Hot Water | 2 gal Hot Water |
| ½ gal Ammonium Hydroxide | ½ gal Ammonium Hydroxide |

The slurries were each spray dried under identical conditions, that is, about 600°F inlet temperature, about 340°F outlet temperature, and about 41 psi atomization air pressure. Following spray drying the dried powders were finish screened to −200 +325 mesh and that size fraction was sintered at 1050°C for about 3½ hours. The bulk properties of the powders which were used for plasma spray coating appear in Table II.

TABLE II

| Mo — 6% $Al_2O_3$ | | Mo — 19% $Al_2O_3$ |
|---|---|---|
| Sieve Analysis (mesh) | +170 − 0% | 0% |
| | +200 − 0 | 0 |
| | +270 −41 | 30 |
| | +325 −36 | 44 |
| | −325 −23 | 26 |
| Bulk Density | 2.26 g/cc | 2.10 g/cc |
| Hall Flow | 33 sec/50g | 38 sec/50g |

Powders were than plasma flame sprayed onto a mild steel plate for metallographic examination. Conditions were as follows: The plasma gun was operated at 600 amps and 32 volts with argon and hydrogen plasma gas flow rates at 32.5 and 18.3 liters per minute respectively, and argon feed gas flow rate at 2.6 liters per minute. A powder feed rate of 473 cc per hour and a gun-to-substrate distance of about 100 millimeters were utilized. Metallographic examination revealed a dense coating with $Al_2O_3$ particles substantially uniformly dispersed in a molybdenum matrix.

Wear testing samples were then prepared as follows: The surfaces of 9 standard size test blocks made of Spartalloy 2-60 cast iron (containing about 3.7 weight percent carbon, 2.5 weight percent silicon, 0.6 weight percent manganese, and 0.6 weight percent chromium) were prepared by grit blasting with 36 mesh grit garnet. Using the above spray parameters for preparation of the metallographic samples, the two powders were sprayed onto three blocks each to a thickness of about 0.25 millimeters and machine ground to a thickness of about 0.15 millimeter. Using identical procedures, three blocks were sprayed with a pure molybdenum powder. The flame sprayed molybdenum surfaces were then gound by hand with 600 grit abrasive powder with final grinding being in the contemplated direction of the wear test. All of these samples were then cleaned per ASTM specification D-2714. The samples were then wear tested on a standard friction and wear test machine against rings also made from Spartalloy 2-60 cast iron. The tests were run for 30,000 cycles at a rate of 200 cycles per minute at an applied load of 136.4 kilograms. Stoddard solvent, a low viscosity hydrocarbon solvent was used as a coolant during testing, such that test temperatures were about 40°C initially, climbing to about 70°C by the termination of testing. Changes in frictional force, width of the wear scar in the coating, and weight loss of both the test block and the ring were recorded. This data, showing the superiority of the coatings of the invention as compared to the pure molybdenum coatings are presented in Table III.

TABLE III

| Coating | Coating Wear Test Data Wear Scar Width (millimeters) | Volume Loss (cubic millimeters) |
|---|---|---|
| Mo | 2.3 | 0.35 |
| Mo—6$Al_2O_3$ | 1.8 | 0.12 |
| Mo—19$Al_2O_3$ | 1.6 | 0.14 |

Diamond pyramid hardnesses at 300 grams ($DPH_{300g}$) of the coatings were also measured. The molybdenum-6 weight percent alumina coating is 157 $DPH_{300g}$ units harder than the pure molybdenum coating while the molybdenum-19 weight percent alumina coating is 42 $DPH_{300g}$ units harder than the 6 weight percent alumina coating and 199 units harder than the pure molybdenum coating.

While there has been shown and described what are at present considered the preferred embodiments of the invention, it will be obvious to those skilled in the art that various changes and modifications may be made therein without departing from the scope of the invention as defined by the appended claims.

What is claimed is:

1. A free flowing flame spray powder comprising agglomerates of powder particles, said agglomerates consisting essentially of subparticles of a metallic component selected from the group consisting of molybdenum and its alloys and from 1 to 50 weight percent of subparticles of an alumina component.

2. The powder of claim 1 wherein the agglomerates consist essentially of from about 5 to 20 weight percent alumina.

3. The powder of claim 1 wherein at least 90 percent of the agglomerate diameters are at least two times the maximum diameter of the subparticles.

4. The powder of claim 3 wherein at least 90 percent of the agglomerate diameters are at least four times the maximum diameter of the subparticles.

5. The powder of claim 1 wherein the metallic component subparticles range in size from 1 to 10 microns.

6. The powder of claim 5 in which the metallic component subparticles range in size from about 2 to 3 microns.

7. The powder of claim 1 wherein the alumina subparticles range in size up to 10 microns.

8. The powder of claim 7 in which the alumina subparticles range in size up to 1 micron.

9. The powder of claim 1 wherein the agglomerate sizes are 90% between minus 200 plus 325 mesh.

* * * * *